US006532937B1

(12) United States Patent
Boecking

(10) Patent No.: US 6,532,937 B1
(45) Date of Patent: Mar. 18, 2003

(54) FUEL INJECTION SYSTEM FOR AN INTERNAL COMBUSTION ENGINE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,768

(22) PCT Filed: Jul. 22, 2000

(86) PCT No.: PCT/DE00/02408

§ 371 (c)(1),
(2), (4) Date: May 11, 2001

(87) PCT Pub. No.: WO01/07778

PCT Pub. Date: Feb. 1, 2001

(30) Foreign Application Priority Data

Jul. 22, 1999 (DE) ..... 199 34 354

(51) Int. Cl.[7] ..... F02M 55/02
(52) U.S. Cl. ..... 123/447; 123/445
(58) Field of Search ..... 123/446, 447, 123/445

(56) References Cited

U.S. PATENT DOCUMENTS 4,541,385 A * 9/1985 Eheim et al. ..... 123/447 X
5,713,331 A 2/1998 Eisenbacher et al. ..... 123/322
6,308,690 B1 * 10/2001 Sturman ..... 123/447 X

FOREIGN PATENT DOCUMENTS

DE 44 07 585 A1 9/1995
DE 197 16 221 A1 10/1998

* cited by examiner

*Primary Examiner*—Tony M. Argenbright
(74) *Attorney, Agent, or Firm*—Robert Bosch GmbH

(57) ABSTRACT

In a fuel injection system for an internal combustion engine, having a fuel high-pressure reservoir, from which an injection line for the fuel to be injected and a drive line for fuel branch off, which fuel is used as a working medium, the fuel is intended to be utilized, in a simple way, in order to furnish a working medium at high pressure that can be used for additional functions. To that end, at least one converter is provided, which is connected to the drive line and in which a volumetric flow of the fuel, which is under pressure, is converted into a volumetric fuel of a working medium which is under pressure.

14 Claims, 2 Drawing Sheets

FUEL INJECTION SYSTEM FOR AN INTERNAL COMBUSTION ENGINE

CROSS REFERENCE TO RELATED APPLICATIONS

This application is a 35 USC 371 application of PCT/DE 00/02408 filed on Jul. 22, 2000.

BACKGROUND OF THE INVENTION

1. Field of the Invention

The invention relates to a fuel injection system for an internal combustion engine, having a fuel high-pressure reservoir, from which an injection line for the fuel to be injected and a drive line for fuel branch off, which fuel is used as a first working medium.

2. Description of the Prior Art

One fuel injection system of the type with which the invention is concerned is already known from German Patent Disclosure DE 44 07 585 A1 and is based on an injection system known by the name "common rail". In this injection system, a cylindrical pressure container is used, to which fuel is delivered by a high-pressure pump. The high-pressure reservoir serves essentially as a buffer, which damps pressure fluctuations that result from the delivery of the fuel by the high-pressure pump and the withdrawal of the fuel by the injection nozzles.

From the above reference, it is known for the fuel present in the high-pressure reservoir to be used for actuating a hydraulic valve controller. To that end, the fuel is first delivered by the drive line to a hydraulic chamber, with which an outlet valve is associated and which is controlled by two control valves, and then to a hydraulic chamber which is associated with an inlet valve and is also controlled by two control valves. By suitable switching of the control valves, the inlet valve and the outlet valve are opened counter to the action of a conventional valve spring and closed again by means of the valve spring.

SUMMARY OF THE INVENTION

The fuel injection system according to the invention, has the advantage that an external consumer, which is actuated not with the fuel itself but rather with an arbitrary other, second working medium, can be connected to the high-pressure reservoir. The converter makes it possible to put the second working medium under a pressure that differs from the fuel pressure.

In one advantageous embodiment of the invention, it is provided that the converter has a translationally displaceable inlet piston and an actuator, by which the inlet piston can be acted upon periodically by fuel under pressure. In this way, at little structural expense, it is possible for the potential energy stored in the fuel under pressure to be converted into a reciprocating motion of the inlet piston, which can then in turn be converted into a volumetric flow of a second working medium that is under pressure.

Preferably, it is provided that the actuator is a 3/2-way valve. Such valves are available in the form of reliable mass-produced components, making the expense for controlling the inlet piston minimal.

In a preferred embodiment of the invention, it is also provided that the converter has a translationally displaceable outlet piston, which is connected to the inlet piston, and two check valves associated with the outlet piston. The outlet piston acts on the order of a piston pump that is driven directly by the inlet piston. Thus a loss- free conversion of the driving energy furnished by the inlet piston is obtained.

Preferably, the cross section of the inlet piston differs from the cross section of the outlet piston. In this way, a conversion of the pressure of the fuel, which is used as a first working medium, into a higher or lower pressure of a second working medium can be attained. For instance, if the cross section of the inlet piston is smaller than the cross section of the outlet piston, then a lesser pressure in the second working medium and a higher volumetric flow, compared to the fuel, are attained. Conversely, if the cross section of the inlet piston is greater than the cross section of the outlet piston, a higher pressure than in the fuel can be attained in the second working medium, although in that case a lesser volumetric flow is available.

In a preferred feature of the invention, a high-pressure reservoir for the second working medium can be provided. This high-pressure reservoir functions similarly to the fuel high-pressure reservoir, in that pressure fluctuations resulting from the delivery of second working medium to its reservoir are damped. Furthermore, withdrawal of the second working medium from its reservoir also leads to only a negligible pressure change in this reservoir, so that this reservoir furnishes the second working medium at an essentially constant pressure.

Furthermore, two converters can be provided, which operate in alternation. In this way, pulsation of the pressure in the second working medium can be further reduced, since a virtually constant pumping of the second working medium is attainable.

BRIEF DESCRIPTION OF THE DRAWINGS

The invention will be more fully described below with specific reference to the drawings, in which.

DESCRIPTION OF THE PREFERRED EMBODIMENTS

Figure 1:
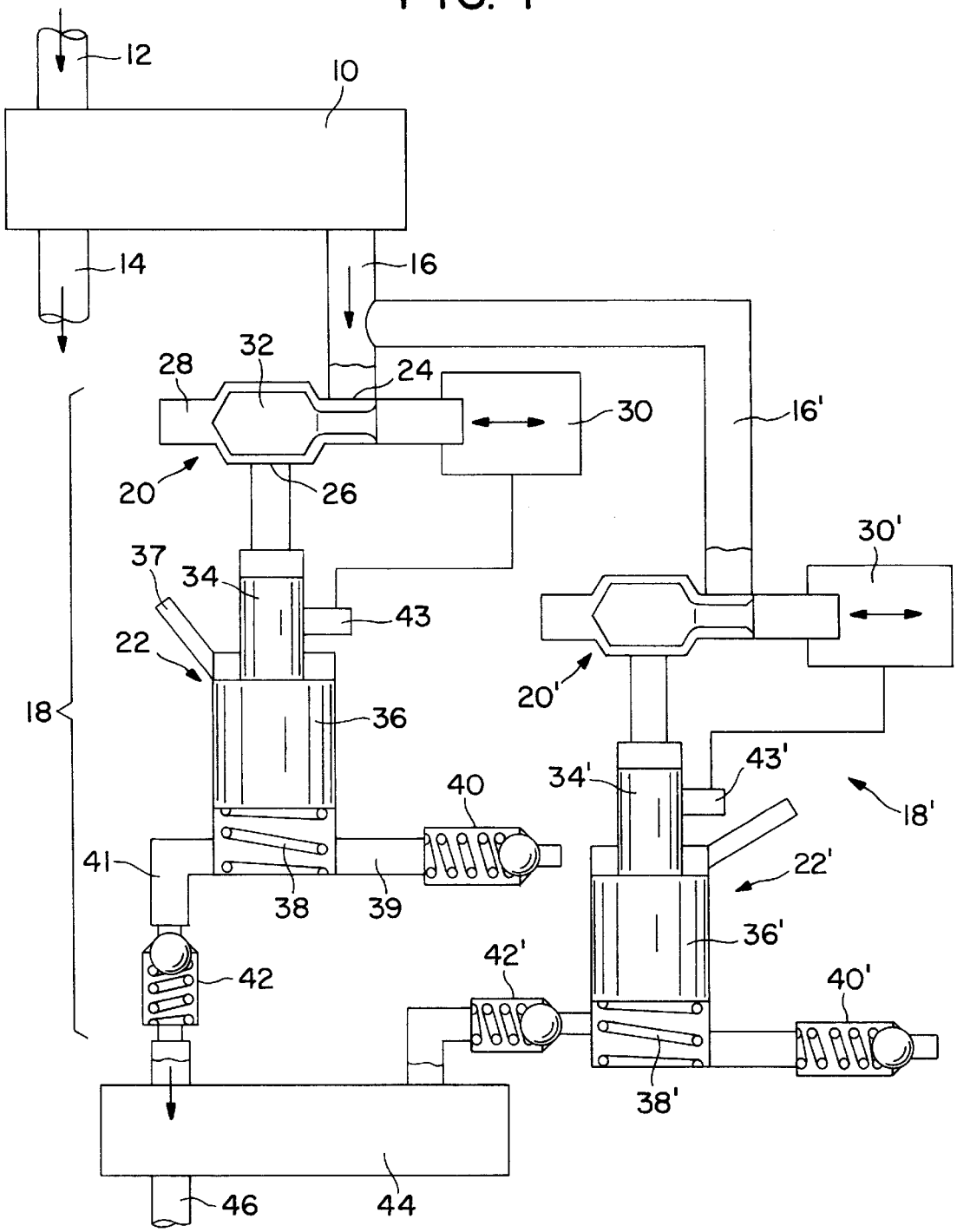
FIG. 1, is a schematic view, of a first embodiment of a fuel injection system according to the invention in a first embodiment.

Referring now to the drawing in detail, FIG. 1 schematically shows a fuel injection system in a first embodiment of the invention. It includes a high-pressure reservoir 10 for fuel, which is used to operate an internal combustion engine, not shown. The fuel is delivered to the high-pressure reservoir 10 through a delivery line 12, which communicates with a high-pressure pump, not shown. From the high-pressure reservoir 10, an injection line 14 for the fuel branches off and leads to the individual injection nozzles of the injection system.

Also branching off from the fuel high-pressure reservoir 10 is a drive line 16, by means of which fuel, which is used as first working medium, can be withdrawn from the high-pressure reservoir.

A converter 18, which comprises an actuator 20 and a piston pump 22, is connected to the drive line 16.

The actuator 20 is a 3/2-way valve, which has one inlet 24, which communicates with the drive line 16, and one outlet 26, communicating with the piston pump 22, as well as another outlet 28, which returns to a fuel reservoir. The actuator 20 furthermore has a valve drive mechanism 30, which is capable of translationally adjusting a valve slide 32.

The piston pump 22 has a translationally displaceable inlet piston 34, which is connected to the outlet 26 of the actuator 20, and a translationally displaceable outlet piston 36, which is solidly connected to the inlet piston 34. A drain line 37 for a leakage flow branches off from an interstice between the inlet piston 34 and the outlet piston 36. A compression spring 38 is braced on the outlet piston 36 and urges the inlet piston and the outlet piston into a position in which the piston pump volume associated with the inlet piston 34 and communicating with the outlet 26 is minimal.

The outlet piston 36 is assigned a working volume into which a delivery line 39 for the second working medium discharges. A check valve 40 is disposed in the delivery line 39. An outlet line 41, in which a check valve 42 is disposed, branches off from the working volume associated with the outlet piston 36. The outlet line 41 leads to a high-pressure reservoir 44 for the second working medium. From the high-pressure reservoir 44, the second working medium can be delivered to a consumer through a withdrawal line 46.

A sensor 43 is mounted on the piston pump 22 and measures both the travel of the inlet piston and the outlet piston and the pressure. These data are made available to the valve drive mechanism 30.

The injection system described, with the converter 18, functions as follows: The valve drive mechanism 30 controls the valve slide 32 in such a way that the inlet piston 34 is periodically acted upon by the fuel under pressure from the high-pressure reservoir 10. In the process, the outlet piston 36 is adjusted downward each time in terms of FIG. 1, and as a result of that, the second working medium is pumped from the delivery line 39 into the outlet line 41 and from there into the high-pressure reservoir 44 for the second working medium. The sensor 43 in this process assures that predetermined values for the stroke of the inlet piston and the outlet piston and for the pressure are adhered to. By the choice of the cross section of the inlet piston 34 relative to the outlet piston 36, the fuel pressure prevailing in the high-pressure reservoir 10 can be converted into a pressure of the second working medium in the high-pressure reservoir 44 which is different from the pressure in the reservoir 10. At the ratio of the cross sections shown in FIG. 1, a high pressure of the fuel in the high-pressure reservoir 10 is converted into a somewhat lower pressure in the second working medium high-pressure reservoir 44, since the cross section of the inlet piston 34 is less than the cross section of the outlet piston 36. Virtually any arbitrary medium can be used as the second working medium, in particular oil or water. The type of second working medium used depends on the particular application.

From the drive line 16, a further drive line 16' branches off, leading to a further converter 18'. In its design and mode of operation, this converter is equivalent to the converter 18, with the sole distinction that it operates in phase displacement with the first converter 18. In other words, if the inlet piston 34 of the first converter 18 is just now being acted upon by pressure, so that it is adjusted counter to the action of the compression spring 38, then the inlet piston 34' is just at the same time not acted upon by pressure, so that it is returned by the compression spring 38'. In this way, the second working medium is delivered to the reservoir 44 in a substantially uniform way, so that the resultant pressure fluctuations in the high-pressure reservoir 44 are only slight.

The described construction thus makes it possible, at comparatively little effort or expense, to utilize the fuel under pressure in the high-pressure reservoir 10 as a first working medium in order to furnish a second working medium in a high-pressure reservoir 44 at high pressure. This second working medium can be used for an arbitrary additional function.

Figure 2:
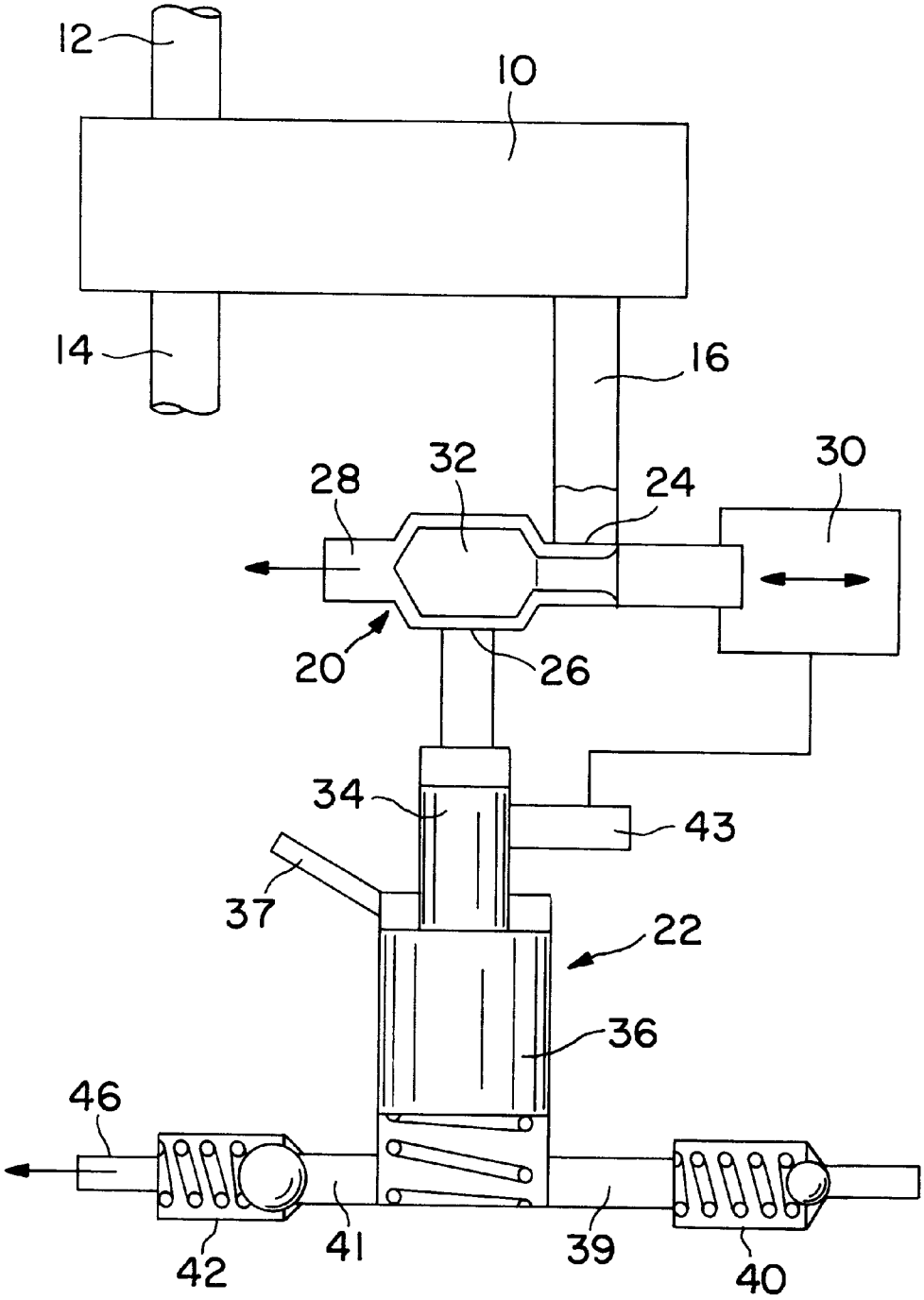
FIG. 2, is a schematic view, similar to FIG. 1 and showing an alternate embodiment of a fuel injection system according to the invention.

In FIG. 2, a simplified embodiment of the system shown in FIG. 1 is shown. Unlike the embodiment shown in FIG. 1, in the embodiment of FIG. 2 only a single converter 18 is used. In addition, no high-pressure reservoir 44 is provided between the second check valve 42 and the withdrawal line 46; in other words, the second working medium is delivered directly to the consumer. This embodiment is especially well suited to quickly furnishing the second working medium, for instance for a safety function.

The foregoing relates to preferred exemplary embodiments of the invention, it being understood that other variants and embodiments thereof are possible within the spirit and scope of the invention, the latter being defined by the appended claims.

I claim:

1. In a fuel injection system for an internal combustion engine, having a fuel high-pressure reservoir (10), from which an injection line (14) for the fuel to be injected and a drive line (16; 16') for fuel branch off, which fuel is used as a first working medium, the improvement wherein at least one converter (18; 18') is provided, which is connected to the drive line (16; 16') and in which a volumetric flow of the fuel, which is under pressure, is converted into a volumetric flow of a second working medium which is under pressure, wherein a high-pressure reservoir (44) for the second working medium is provided.

2. The fuel injection system of claim 1, wherein the converter (18; 18') has a translationally displaceable inlet piston (34; 34') and an actuator (20; 20'), by which the inlet piston can be acted upon periodically by fuel under pressure.

3. The fuel injection system of claim 2, wherein the actuator is a 3/2-way valve (20; 20').

4. The fuel injection system of claim 9, wherein the converter (18; 18') has a translationally displaceable outlet piston (36; 36'), which is connected to the inlet piston (34; 34'), and two check valves (40, 42; 40', 42') associated with the outlet piston.

5. The fuel injection system of claim 4, wherein the cross section of the inlet piston (34; 34') differs from the cross section of the outlet piston (36; 36').

6. The fuel injection system of claim 1, wherein two converters (18; 18') are provided, which operate in alternation.

7. The fuel injection system of claim 3, wherein the converter (18; 18') has a translationally displaceable outlet piston (36; 36'), which is connected to the inlet piston (34; 34'), and two check valves (40, 42; 40', 42') associated with the outlet piston.

8. The fuel injection system of claim 7, wherein the cross section of the inlet piston (34; 34') differs from the cross section of the outlet piston (36; 36').

9. The fuel injection system of claim 2, wherein two converters (18; 18') are provided, which operate in alternation.

10. The fuel injection system of claim 3, wherein two converters (18; 18') are provided, which operate in alternation.

11. The fuel injection system of claim 4, wherein two converters (18; 18') are provided, which operate in alternation.

12. The fuel injection system of claim 5, wherein two converters (18; 18') are provided, which operate in alternation.

13. The fuel injection system of claim 8, wherein two converters (18; 18') are provided, which operate in alternation.

14. The fuel injection system of claim 5, wherein two converters (18; 18') are provided, which operate in alternation.

* * * * *